US009388542B2

(12) United States Patent
Krueger et al.

(10) Patent No.: US 9,388,542 B2
(45) Date of Patent: Jul. 12, 2016

(54) APPARATUSES, SYSTEMS, AND METHODS FOR CLEARING A SURFACE USING PRESSURIZED AIR

(71) Applicant: National Association for Stock Car Auto Racing, Inc., Daytona Beach, FL (US)

(72) Inventors: Donald E. Krueger, Stony Point, NC (US); John K. Sutton, Concord, NC (US); Michael D. Horton, Concord, NC (US); Shawn Rogers, Huntersville, NC (US); John Austin Tate, IV, Charlotte, NC (US); Jerome Kaproth, Mooresville, NC (US)

(73) Assignee: National Association for Stock Car Auto Racing, Inc., Daytona Beach, FL (US)

( * ) Notice: Subject to any disclaimer, the term of this patent is extended or adjusted under 35 U.S.C. 154(b) by 752 days.

(21) Appl. No.: 13/757,114

(22) Filed: Feb. 1, 2013

(65) Prior Publication Data

US 2014/0220879 A1 Aug. 7, 2014

(51) Int. Cl.
*E01H 1/08* (2006.01)

(52) U.S. Cl.
CPC ..... *E01H 1/0809* (2013.01)

(58) Field of Classification Search
CPC ..... E01H 1/0809; A47L 5/14; B08B 5/02; B08B 3/102
See application file for complete search history.

(56) References Cited

U.S. PATENT DOCUMENTS

| | | | |
|---|---|---|---|
| 3,902,219 | A | 9/1975 | Jones |
| 3,999,243 | A | 12/1976 | La Pour |
| 4,062,085 | A | 12/1977 | Duncan |
| 4,105,429 | A | 8/1978 | Delgado |
| 4,513,915 | A | 4/1985 | Kohler et al. |
| 4,887,545 | A | 12/1989 | Soininen |
| 5,074,242 | A | 12/1991 | Briemont |

(Continued)

FOREIGN PATENT DOCUMENTS

| | | | |
|---|---|---|---|
| CN | 102858148 | A | 1/2013 |
| DE | 39 14 348 | A1 | 10/1990 |

(Continued)

OTHER PUBLICATIONS

International Search Report and Written Opinion for Application No. PCT/US2014/012941 dated May 6, 2014.

(Continued)

*Primary Examiner* — Dung Van Nguyen
(74) *Attorney, Agent, or Firm* — Alston & Bird LLP

(57) ABSTRACT

Provided are apparatuses, methods, and systems to clear a road surface of debris, water, or other contaminants. A system for clearing a road surface is provided including an air knife with an elongate orifice extending along a line, a frame configured to support the air knife in a position substantially parallel to a plane defined by the road surface, and a tow bar coupled to the frame, where the tow bar is pivotable relative to the frame along an axis orthogonal to the plane defined by the road surface. The system may include a mounting plate connected to the tow bar, where the mounting plate is pivotably mounted to the frame. The air knife may be supplied with pressurized air to clear the road surface of debris. A guide wheel may be attached to the frame, where the guide wheel is configured to rotate about an axis orthogonal to the plane defined by the road surface.

20 Claims, 12 Drawing Sheets

(56) References Cited

U.S. PATENT DOCUMENTS

| | | | | |
|---|---|---|---|---|
| 5,189,832 | A | 3/1993 | Hoek et al. | |
| 5,377,381 | A | 1/1995 | Wilson | |
| 5,533,577 | A | 7/1996 | Jucker | |
| 5,566,535 | A | 10/1996 | Pruitt | |
| 5,673,457 | A | 10/1997 | Webster et al. | |
| 5,746,539 | A | 5/1998 | Mara | |
| 6,049,943 | A | 4/2000 | Carter | |
| 6,073,305 | A | 6/2000 | Hesskamp | |
| D431,254 | S | 9/2000 | Koberlein | |
| 6,146,092 | A | 11/2000 | Botros et al. | |
| 6,189,179 | B1 | 2/2001 | Baird | |
| 6,260,231 | B1 | 7/2001 | Bybee et al. | |
| 6,286,228 | B1 | 9/2001 | Bodnar et al. | |
| 6,298,578 | B1 | 10/2001 | Frampton | |
| 6,308,635 | B1 | 10/2001 | Abele | |
| 6,412,570 | B1 | 7/2002 | Pruitt et al. | |
| 6,464,083 | B1 * | 10/2002 | Harrison | E01H 1/14 15/340.1 |
| 6,493,902 | B2 | 12/2002 | Lin | |
| 6,742,285 | B2 | 6/2004 | Shepard | |
| 6,776,432 | B2 | 8/2004 | Harkcom et al. | |
| 6,990,751 | B2 | 1/2006 | Riley et al. | |
| D527,028 | S | 8/2006 | Ford | |
| 7,134,262 | B2 | 11/2006 | Erwig | |
| 7,216,396 | B2 | 5/2007 | Slawinski | |
| 7,520,314 | B2 | 4/2009 | Hwang et al. | |
| D623,669 | S | 9/2010 | Kromminga et al. | |
| 7,823,303 | B2 | 11/2010 | Nagamatsu et al. | |
| D646,699 | S | 10/2011 | Knobloch et al. | |
| 8,256,198 | B2 | 9/2012 | Thompson | |
| D668,687 | S | 10/2012 | Kromminga | |
| 8,281,499 | B2 | 10/2012 | Freisen et al. | |
| 2003/0140610 | A1 | 7/2003 | Boyko | |
| 2007/0281094 | A1 | 12/2007 | Nishio et al. | |
| 2009/0113660 | A1 * | 5/2009 | Stell | E01H 1/0872 15/340.4 |
| 2010/0024242 | A1 | 2/2010 | Friesen et al. | |
| 2010/0120350 | A1 | 5/2010 | Pucciani | |
| 2011/0146721 | A1 * | 6/2011 | Meister | B01D 41/00 134/22.1 |
| 2012/0255585 | A1 | 10/2012 | Kowalczyk | |

FOREIGN PATENT DOCUMENTS

| | | | |
|---|---|---|---|
| EP | 0 340 692 | A1 | 11/1989 |
| EP | 0 652 998 | A1 | 5/1995 |
| FR | 2 590 290 | A1 | 5/1987 |
| GB | 2 389 037 | A | 12/2003 |
| WO | WO 94/26982 | A1 | 11/1994 |
| WO | WO 2010/034095 | A1 | 4/2010 |
| WO | WO 2011/117660 | A2 | 9/2011 |

OTHER PUBLICATIONS

Office Action from Chinese Patent Application No. 201480007152.2 dated May 10, 2016.

* cited by examiner

APPARATUSES, SYSTEMS, AND METHODS FOR CLEARING A SURFACE USING PRESSURIZED AIR

TECHNOLOGICAL FIELD

Embodiments of the present invention relate generally to apparatuses, systems, and methods for clearing a surface. In particular, embodiments may include a system which is configured to clear water, oil, debris, or other objects from a surface such as a road surface as the system advances over the road surface.

BACKGROUND

Racetracks, highways, runways, roads, parking lots, and other like surfaces, generally referred to herein collectively and individually as road surfaces, are generally engaged by tires of vehicles which may be made of rubber, synthetic rubber, or similar compounds. Tires generally grip a road surface better when the road surface and tire are dry and the road surface is free of debris. The introduction of contaminants to a road surface, such as water, oil, gravel, tire particles, etc. may reduce the grip between a tire and the road surface. As such, clearing the road surface of debris and drying the road surface may improve the grip of a tire on the road surface.

While cars and aircraft may traverse wet road surfaces, stopping distances and handling may be reduced. In some applications, such as some forms of automobile racing where speeds and turning forces may be significantly higher than standard driving traffic, racing on a wet track may be hazardous enough that races may be suspended until the track is dry or clear of other debris. In such applications, actively drying the track may allow automobile racing, time trials, practices, qualifying, and the like to start or resume faster than allowing the track to passively dry naturally. Actively drying the racetrack quickly may also reduce fan disappointment and operating expenses resulting from a race that is prolonged or canceled due to track conditions, such as a wet track. Wet road surfaces can also cause issues when temperatures drop below freezing and the wet road surfaces become icy.

SUMMARY

Embodiments of the present invention may provide for a system for clearing a road surface of contaminants, such as water, debris, or other contaminants. In one embodiment, a system for clearing a road surface is provided including an air knife with an elongate orifice extending along a line, a frame configured to support the air knife in a position substantially parallel to a plane defined by the road surface, and a tow bar coupled to the frame, where the tow bar is pivotable relative to the frame along an axis orthogonal to the plane defined by the road surface. The tow bar may include a mounting plate, where the mounting plate is pivotably mounted to the frame. The mounting plate may be pivotable in a first pivot direction about the axis orthogonal to the plane defined by the road surface and pivotable in a second pivot direction, opposite the first pivot direction, about the axis orthogonal to the plane defined by the road surface.

A road surface clearing system according to some example embodiments may include a biasing member configured to bias the mounting plate in at least the first pivot direction. The degree of pivot between the mounting plate and the frame may be limited by a pivot stop. The degree of pivot may be between about zero degrees relative to a direction of travel of the system and forty-five degrees relative to the direction of travel of the system. The elongate orifice may be disposed at an angle relative to the direction of travel of the system, such as between zero and ninety degrees, between about forty and seventy degrees, or about sixty degrees. The angle of incidence of air exiting the elongate orifice relative to the plane defined by the road surface may be between about thirty and sixty degrees. The angle of incidence of the air exiting the elongate orifice relative to the plane defined by the surface may be about forty-five degrees.

A road surface clearing system according to some example embodiments may include a guide wheel attached to the frame with an axis of rotation orthogonal to the plane defined by the road surface. The system may define a direction of travel in which the system is advanced by a tow vehicle, and the guide wheel may be adapted to engage a wall extending parallel to the direction of travel. The biasing member may be configured to bias the guide wheel into engagement with the wall.

Some embodiments may further include a manifold attached to the frame, a first hose extending from the manifold to a first end of the air knife, and a second hose extending from the manifold to a second end of the air knife.

Some embodiments of the road surface clearing system may include a second air knife including an elongate orifice extending along a line, and a second frame configured to support the air knife in a position substantially parallel to the plane defined by the road surface, where the second frame is attached to the first frame. The second frame may be pivotable relative to the first frame about a first axis and about a second axis, where the first axis and the second axis are perpendicular to one another, and the first axis and the second axis are each parallel to the plane defined by the road surface. A direction of travel of the first frame and a direction of travel of the second frame may be held fixed parallel to one another, and may be parallel to a direction of travel in which the system is configured to be advanced by a tow vehicle.

Some embodiments may further include a manifold attached to one of the first frame or the second frame, a first hose extending from the manifold to a first end of the first air knife, a second hose extending from the manifold to a second end of the first air knife, a third hose extending from the manifold to a first end of the second air knife, and a fourth hose extending from the manifold to a second end of the second air knife.

DESCRIPTION OF THE DRAWINGS

Figure 1:
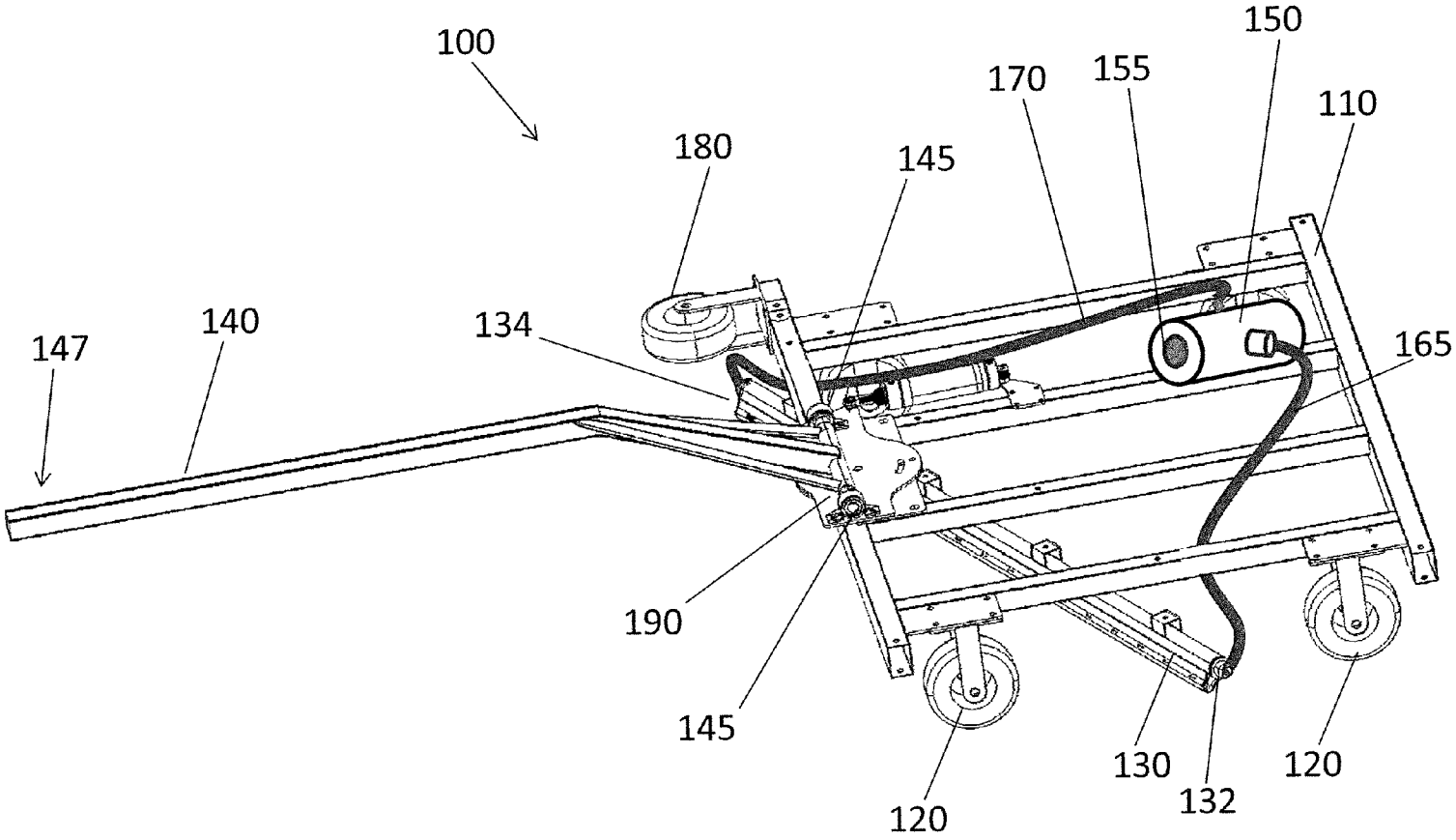
Figure 2:
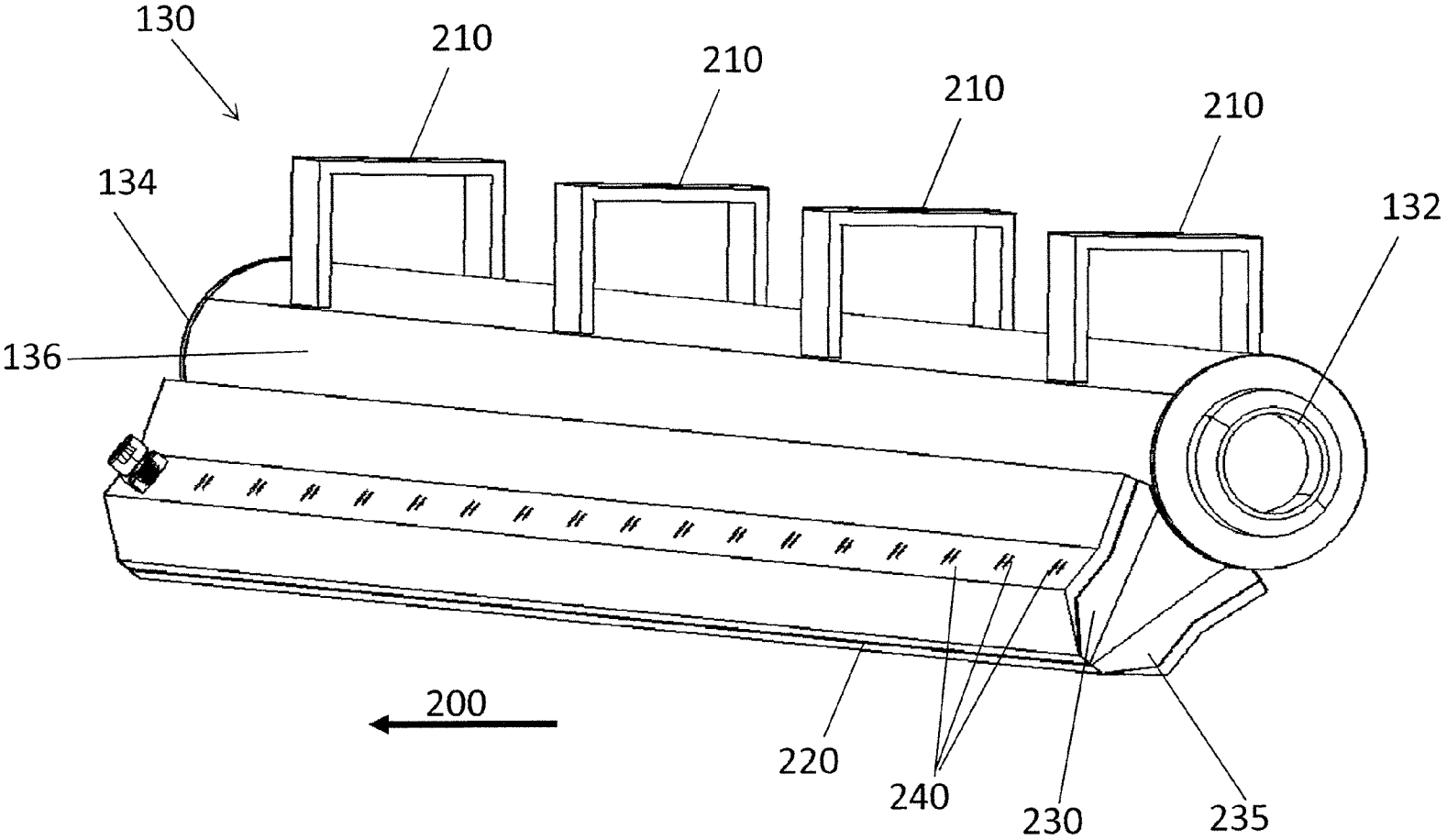
Figure 3:
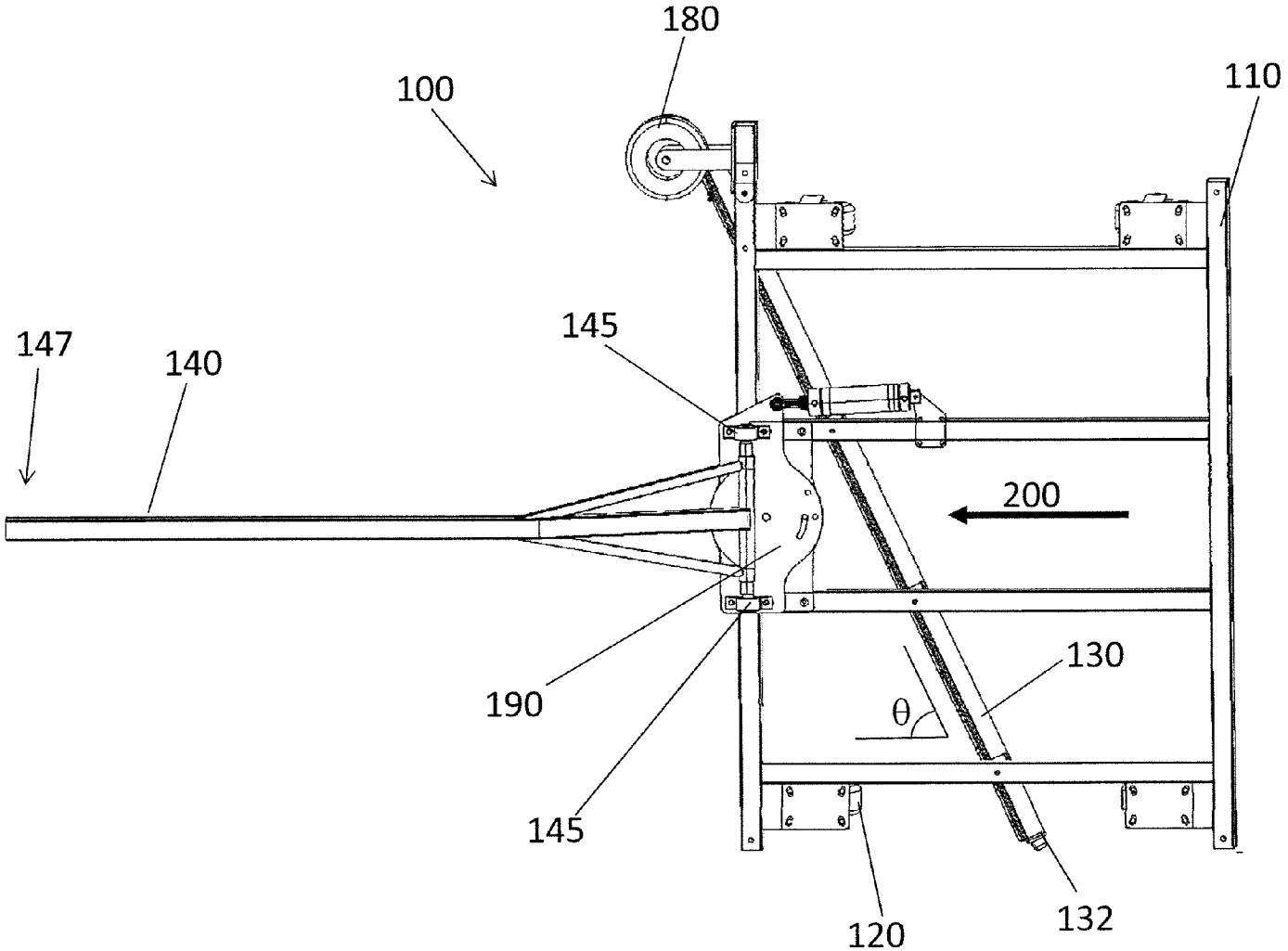
Figure 4:
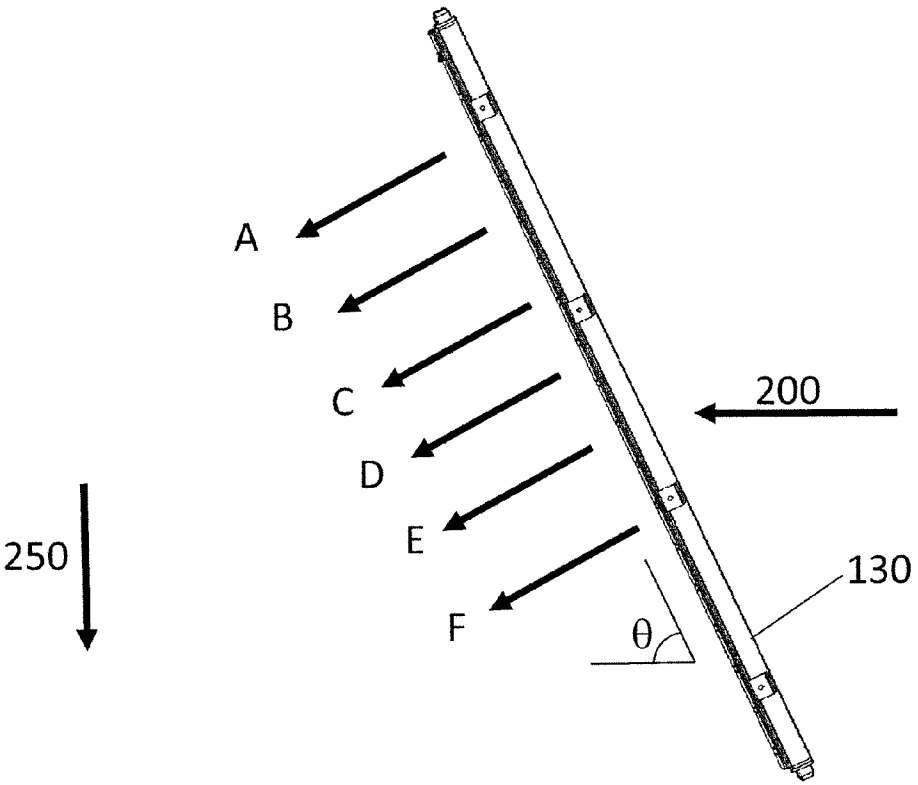
Figure 5:
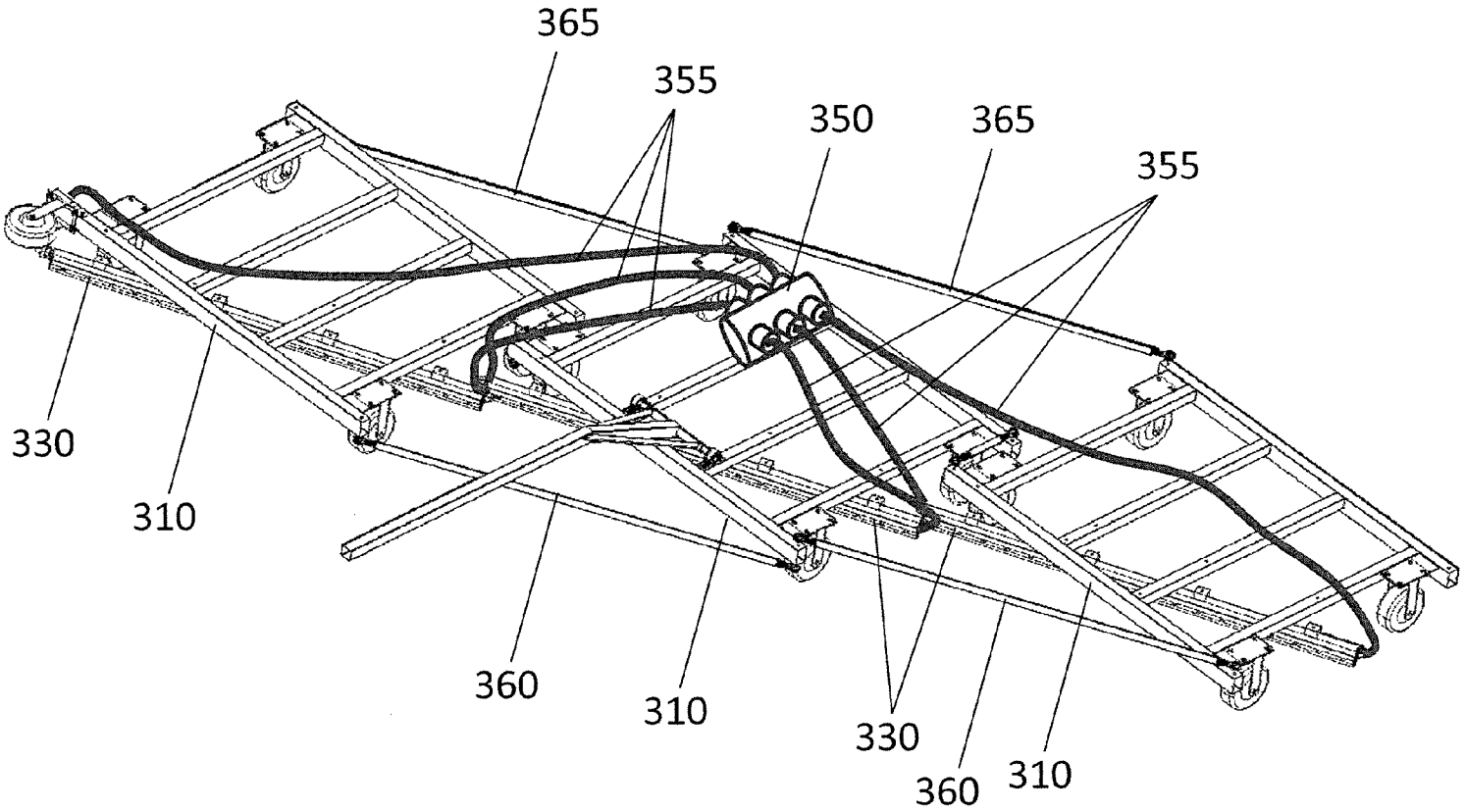
Figure 6:
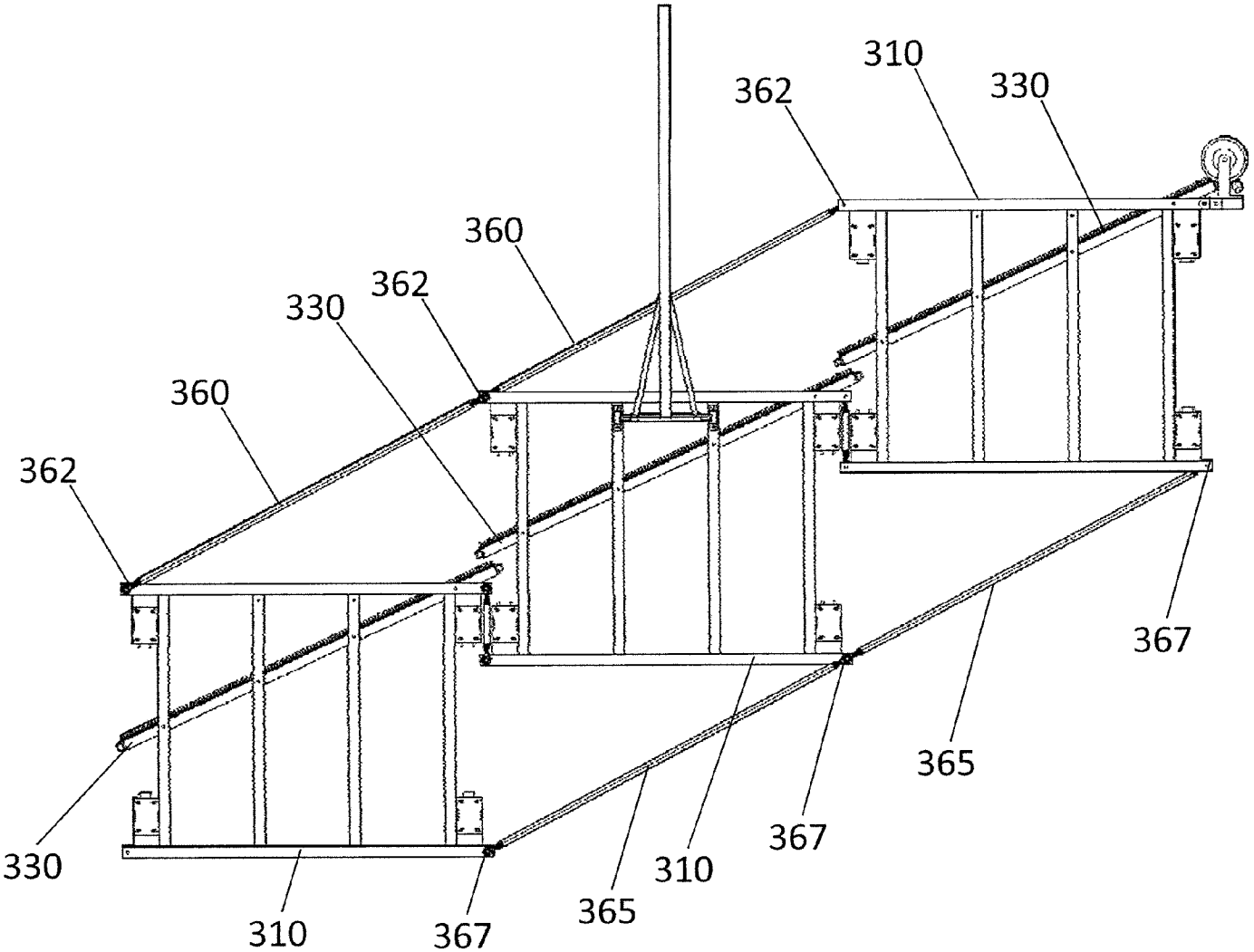
Figure 7:
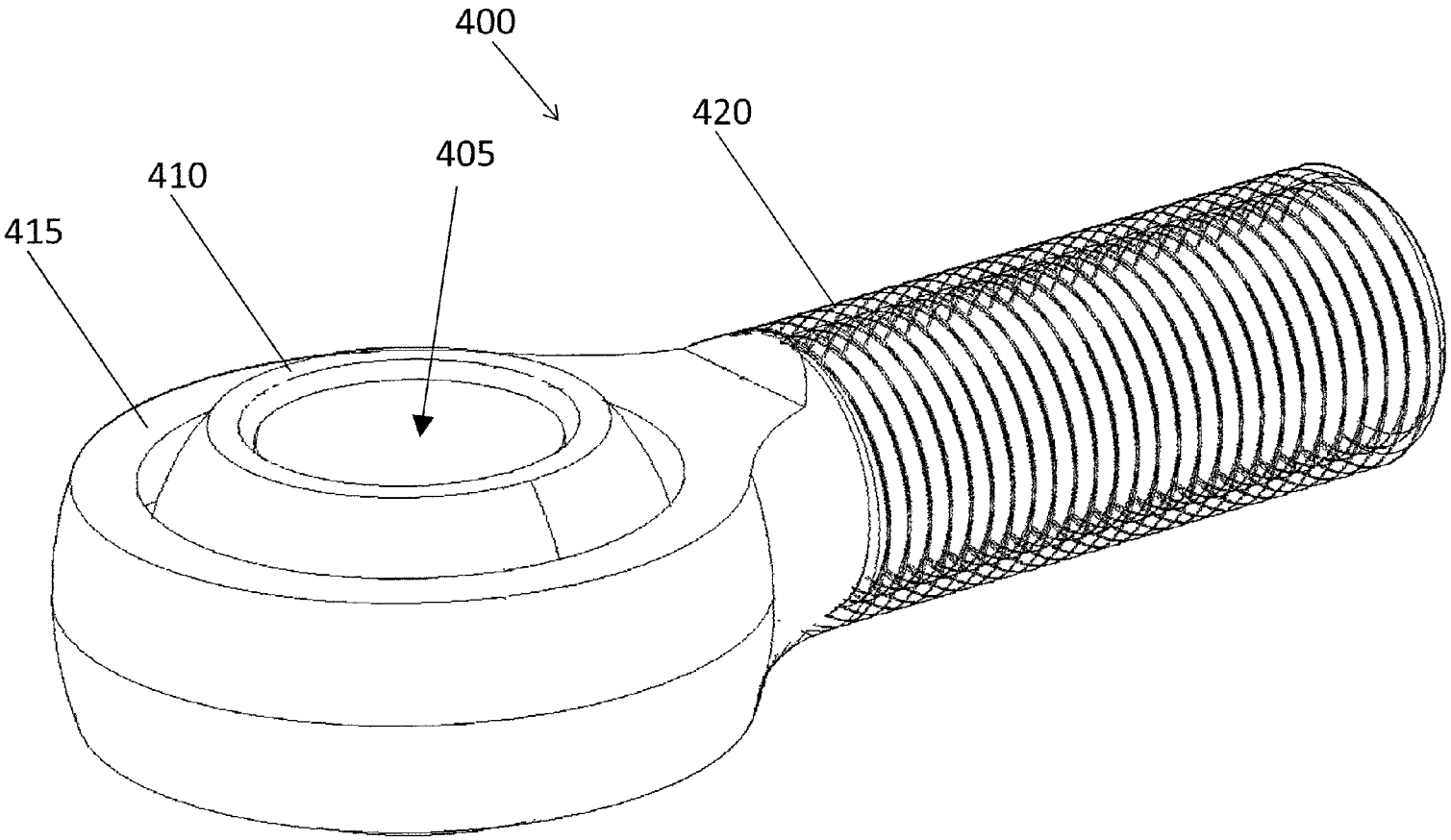
Figure 8:
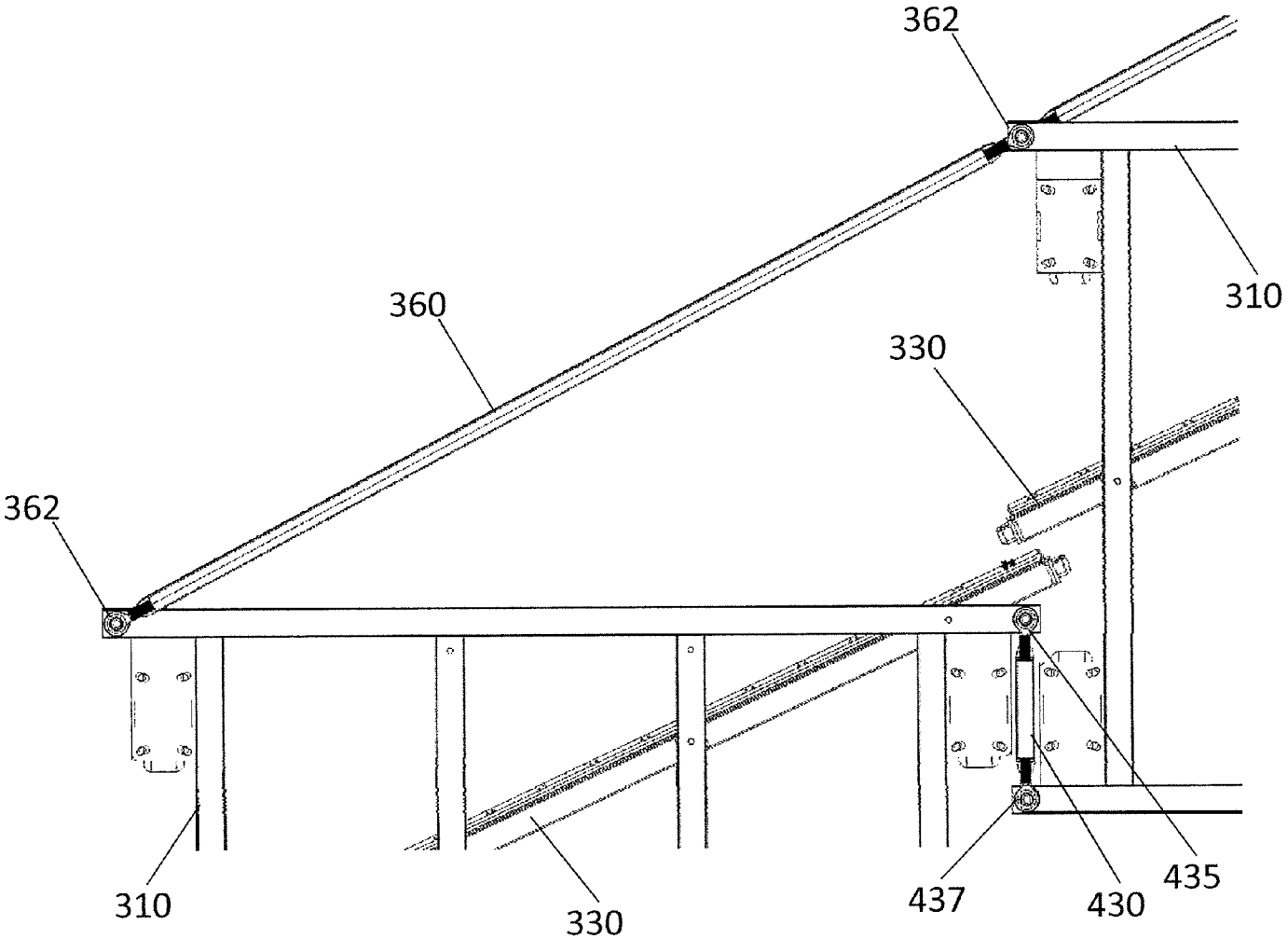
Figure 9:
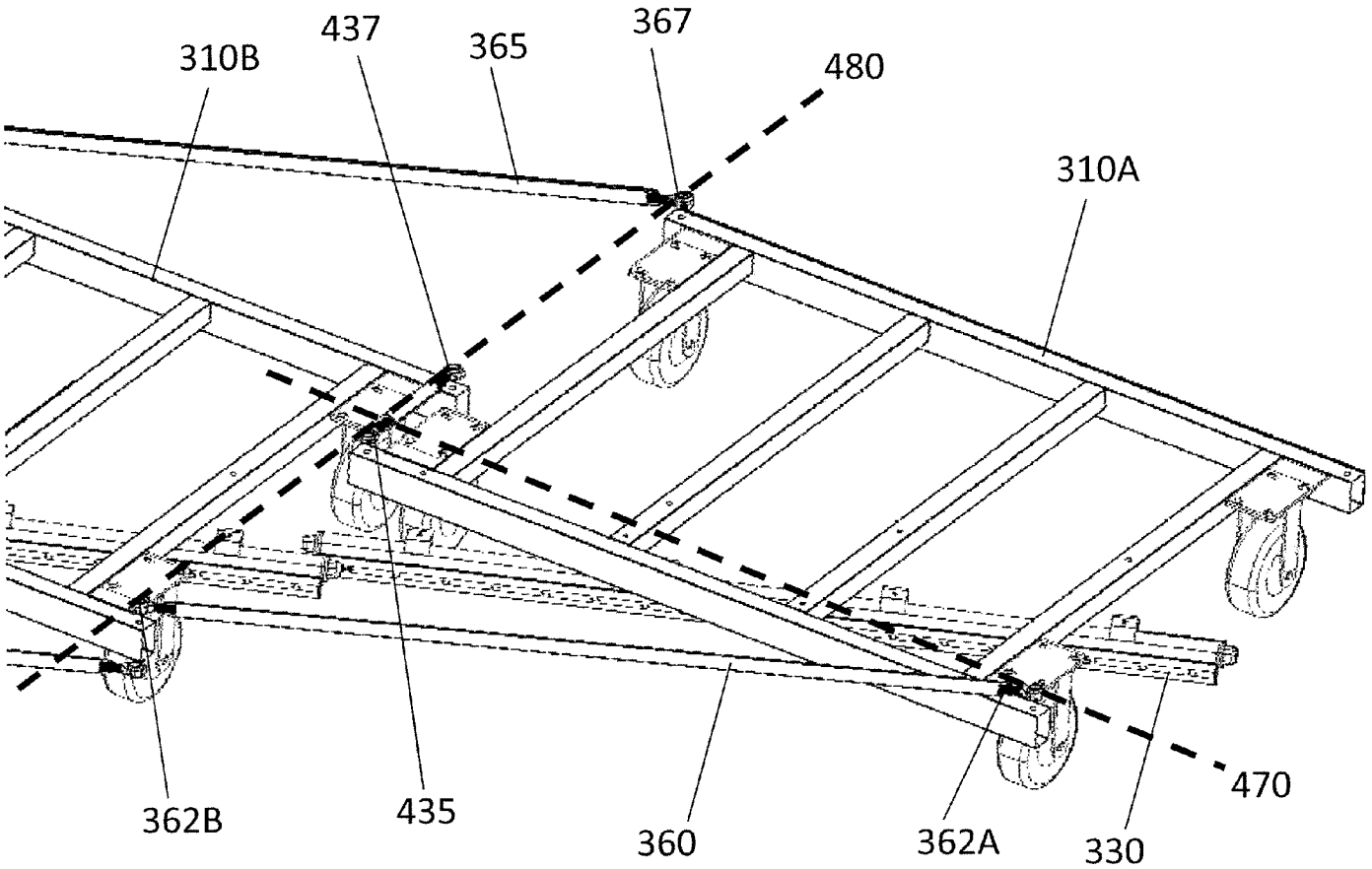
Figure 10:
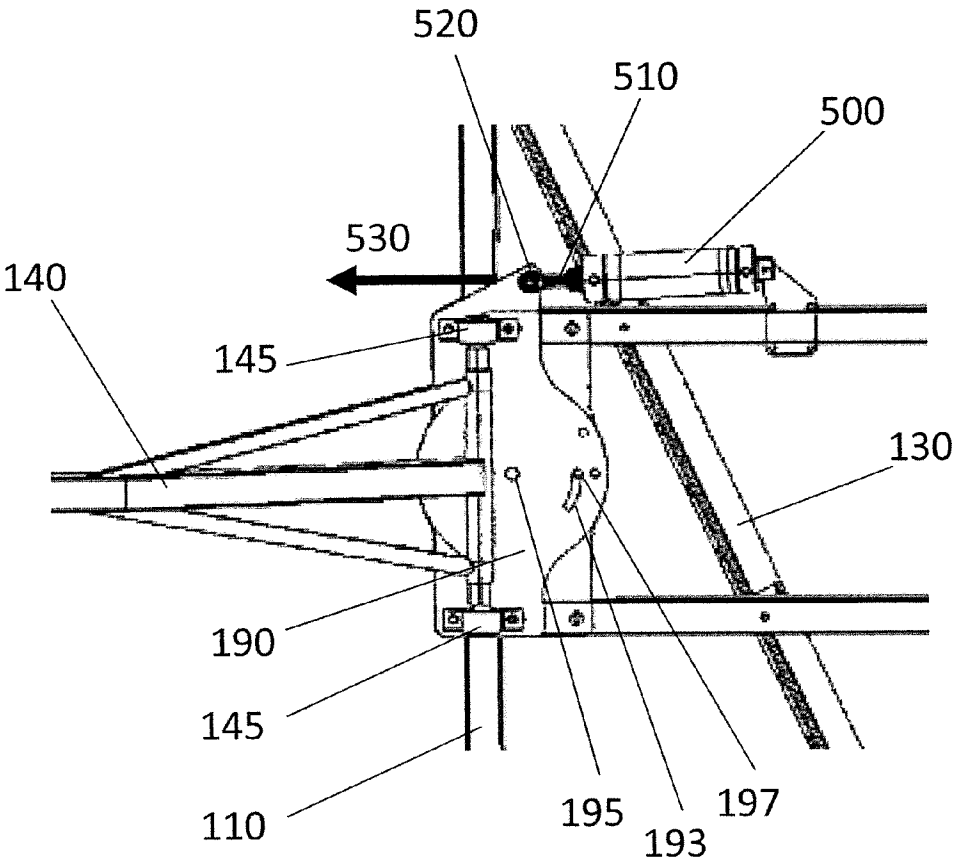
Figure 11:
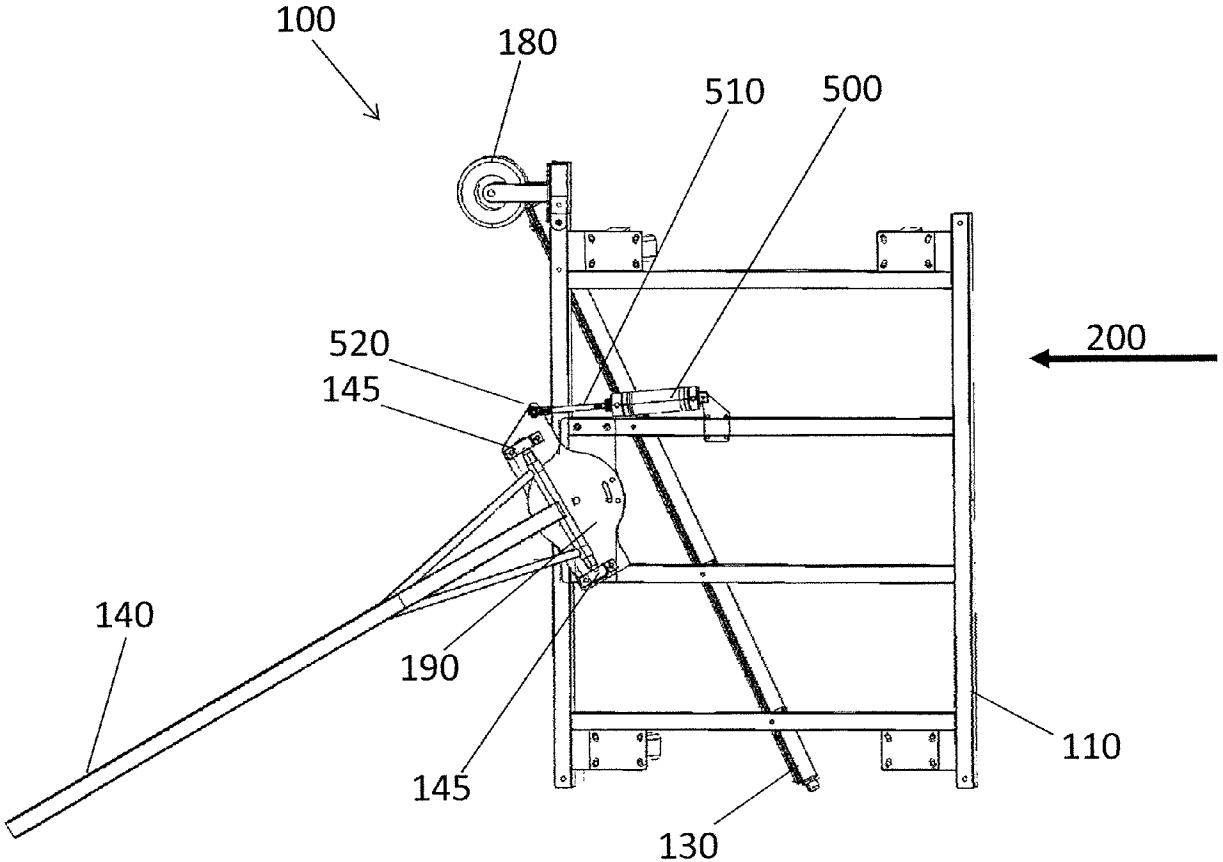
Figure 12:
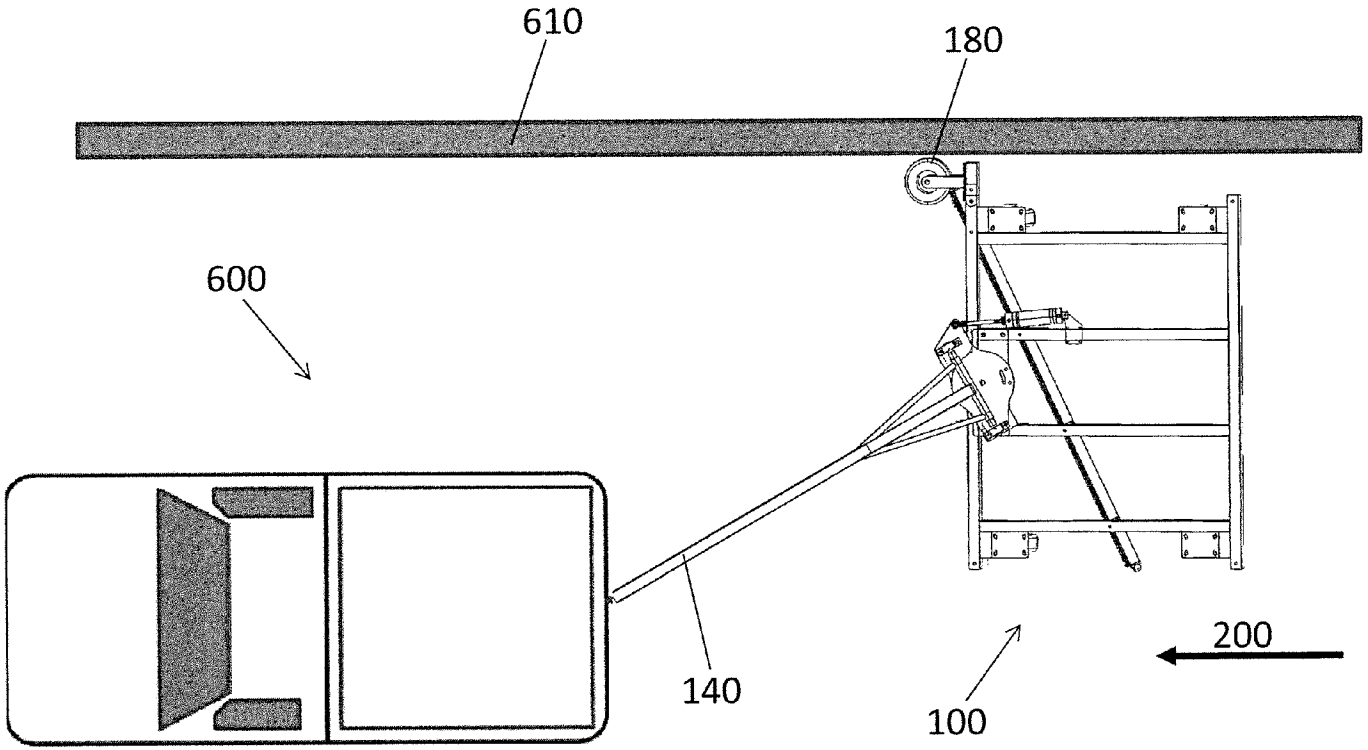

Having thus described the invention in general terms, reference will now be made to the accompanying drawings, which are not necessarily drawn to scale, and wherein:

FIG. 1 illustrates a perspective view of a road surface clearing system according to an example embodiment of the present invention;

FIG. 2 illustrates a perspective view of an air knife that may be used in a road surface clearing system according to example embodiments of the present invention;

FIG. 3 illustrates the road surface clearing system of FIG. 1 as viewed from above;

FIG. 4 illustrates the air knife of the road surface clearing system of FIG. 3 shown exclusive of surrounding components;

FIG. 5 illustrates a perspective view of a road surface clearing system according to another example embodiment of the present invention;

FIG. 6 illustrates the example embodiment of FIG. 5 as viewed from above;

FIG. 7 illustrates a ball joint rod end as used in example embodiments of the present invention;

FIG. 8 illustrates a detail view a system of fastening together adjacent frames of a surface clearing system according to example embodiments of the present invention;

FIG. 9 illustrates a perspective detail view of the fastening system of FIG. 8;

FIG. 10 illustrates an example embodiment of a mechanism for allowing a tow bar to pivot relative to the frame of road surface clearing system according to example embodiments of the present invention;

FIG. 11 depicts an example embodiment of a road surface clearing system with the tow bar pivoted relative to the frame according to the present invention; and FIG. 12 illustrates a surface clearing system as towed behind a tow vehicle according to an example embodiment of the present invention.

DETAILED DESCRIPTION

The present invention will now be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention may provide for a system to clear material, herein generally also referred to as contaminants, from a road surface. In some embodiments, the material to be cleared may be debris, such as gravel, rubber, trash, etc. from a racetrack surface or an airport runway. In other embodiments, the material to be cleared may be water for purposes of drying a road surface. As will be appreciated, embodiments of the present invention may be implemented for clearing a wide variety of materials from a road surface such that embodiments described herein are not intended to be limiting, but merely provide example embodiments of applications of the invention. As such, embodiments described herein are primarily described in the context of clearing water from a road surface such as a racetrack or runway to dry the surface.

As outlined above, road surfaces with contaminants such as debris or water may reduce the grip available to vehicles traversing the road surfaces and clearing the road surface of debris and drying the road surface may dramatically improve the grip of a tire on the road surface. Example embodiments of the present invention may enable a user to clear debris from a road surface and/or to dry a surface quickly. Further, as wet road surfaces can also cause issues when temperatures drop below freezing and the wet road surfaces become icy road surfaces, embodiments may also be useful to dry the road surfaces before the water freezes to ice. In some embodiments, heat may also be used to assist in drying the road surface and/or even helping to melt and remove snow and ice from road surfaces.

FIG. 1 illustrates an example embodiment of a road surface clearing system 100 of the present invention including a frame 110 with wheels 120 and an air knife 130 suspended from the frame 110. The air knife may be suspended from the frame by a mechanism, such as a series of bolts, which can raise and lower the air knife relative to a road surface over which the frame rides, being carried by the wheels 120. The frame may include a tow bar 140 which may be used to pull, or in some embodiments push, in a direction of travel along the road surface.

The road surface along which the road surface clearing system 100 may be pulled may include contours and undulations to some extent; however, for purposes of the disclosure, the road surface, and in particular, the portion of the road surface over which the frame 110 rides, will be described as substantially planar or defining a plane of the road surface.

The tow bar 140 of the road surface clearing system 100 may be hingedly attached to the frame 110 at hinge points 145. The pivot points may allow the towed end 147 of the tow bar 140 to move vertically up and down relative to the road surface being cleared. The hinge between the tow bar 140 and the frame 110 may allow for tow vehicles with different height tow hitches or receivers, onto or into which the towed end 147 of the tow bar 140 may be mounted. Further, the hinge may accommodate undulations in the road surface between the tow vehicle and the road surface clearing system 100.

The tow vehicle used to pull (or push) a road surface clearing system 100 of example embodiments may be any suitable vehicle capable of moving the system. In some embodiments, the towed end 147 of the tow bar 140 may be indirectly coupled to a tow vehicle, such as by a boom or telescoping arm such that the surface clearing system 100 may not be located directly behind the tow vehicle as will be described further below.

Road surface clearing systems of example embodiments may function, as detailed further below, by directing pressurized air through the air knife 130 toward the surface to be cleared. The air knife may be fed pressurized air through at least one inlet, such as inlets on a first end of the air knife 132 and a second end of the air knife 134. A first hose 165 may supply the compressed air to the first end 132, and a second hose 170 may supply the compressed air to the second end 134. Each of the first hose 165 and the second hose 170 may be connected to a manifold 150 which distributes pressurized air to the hoses. The manifold may be fed by one or more compressors, through one or more hoses connected to inlet 155.

Pressurized air supplied by a compressor may include oil or oil vapor that is residue from the compressing process. As such, to prevent the road surfaces that are to be cleared from having oil deposited thereon, one or more filters may be implemented between the pressurized air source and the air knives to remove the oil from the pressurized air before being used to clear the road surface.

FIG. 2 illustrates the air knife 130 as viewed from the side of the road surface clearing system without the components of the remainder of the system for ease of illustration and understanding. As illustrated, the air knife 130 includes mounting brackets 210 configured to mount the air knife 130 to the frame (such as frame 110 of FIG. 1). The mounting brackets 210 may be attached to the frame by adjustable fasteners such that the position of the air knife 130 relative to the frame is adjustable. The adjustability of the position of the air knife 130 relative to the frame allows for more precise positioning of the air knife 130 relative to the road surface that is to be cleared while maintaining sufficient distance from the surface to avoid obstacles and to avoid scraping the surface when the frame moves over undulations or apexes in the surface. An example working height for the air knife 130 above the surface may be between about one-half inch and two inches, or preferably in some uses about one inch. However, as embodiments may be used for clearing larger debris or for providing an air flow of a higher temperature, the height of the air knife 130 above the surface may be increased significantly to about 12 inches, in dependence upon the type of debris to be cleared, the temperature of the pressurized air, and the type of surface that is being cleared.

The air knife 130 may define an elongate orifice 220 through which the pressurized air is expelled from the air knife 130. The pressurized air is received at the air knife at both ends 132 and 134. While the illustrated example of an air knife is configured to receive pressurized air from both ends of the air knife, alternative embodiments may receive pressurized air from only one end, or from one or more orifices disposed along the length of the air knife. An advantage to receiving the pressurized air at both ends 132, 134 of the air knife is that a more consistent pressure of air exiting the elongate orifice 220 may be achieved. The elongate orifice 220 of the illustrated example is defined by a top plate 230 and a bottom plate 235 which are attached to a body 136 of the air knife 130. While the elongate orifice 220 of some embodiments may be defined by integrally formed portions of the air knife, such as in an extruded channel, the illustrated embodiment includes an adjustable width orifice 220. Fasteners 240 are disposed along the length of the top plate and may be configured to allow adjustability of the width of the elongate orifice 220. An example elongate orifice width may be about 0.005 to about 0.050 inches, or about 0.010 inches.

An adjustable width elongate orifice may be advantageous to allow more consistent flow to be achieved across the length of the orifice 220. For example, the flow rate of pressurized air may tend to be higher closer to the pressurized air entrance to the air knife body 136 (e.g., proximate the air knife ends 132, 134) such that adjusting the orifice 220 width proximate the air knife ends to be narrower, while the orifice width proximate the middle of the air knife is wider, may achieve more consistent flow across the length of the elongate orifice. Further, the adjustable width of the elongate orifice may assist in compensating for material and manufacturing variances, air knife deflection, and warping of the air knife.

As illustrated in FIG. 2, the elongate orifice is directed downward, toward a road surface, and in the direction of movement of a frame illustrated by arrow 200. The elongate orifice may be directed downward, toward the road surface to be cleared such that a planar, blade-like stream (i.e., knife) of pressurized air exiting the elongate orifice impinges the road surface to be cleared at an angle between thirty degrees and sixty degrees, or preferably in some uses, around forty-five degrees.

During operation, the road surface clearing system 100 of FIG. 1 may be towed behind a tow vehicle (or a boom as noted above). The manifold 150 may be supplied with pressurized air, which is distributed through the manifold 150 to both the first hose 165 and the second hose 170. The pressurized air is received at the first end 132 and the second end 134 of the air knife and directed through the body 136 of the air knife to exit through the elongate orifice 220.

FIG. 3 illustrates the road surface clearing system of FIG. 1 as viewed from above. As shown, the air knife 130 is disposed at an angle θ relative to the direction of travel 200. The angle θ may be between zero and ninety degrees, with zero being parallel to the direction of travel 200 and ninety degrees being perpendicular to the direction of travel. The angle θ may be aligned to the left, as illustrated, or to the right in relation to the direction of travel. The angle θ may be adjustable and may be chosen based upon the application, such as the type of material being cleared from a surface. In an example embodiment in which water is being removed from an asphalt or concrete road surface, an angle θ may preferably be between about forty degrees and seventy degrees, and more preferably, about sixty degrees as illustrated.

Further, as pressurized air may be heated above ambient air temperature as a result of the compression, the pressurized air entering the air knife and exiting to the surface to be cleared may have an elevated temperature. This may be beneficial for drying road surfaces as the heat will encourage water vaporization. In some embodiments, heat may be introduced to the pressurized air or indirectly upon the road surface by a heater to speed the drying process when the road surface clearing system is used for drying a road surface.

FIG. 4 illustrates the air knife 130 of the view of FIG. 3 without the frame 110 or ancillary components for ease of illustration and understanding. As shown, the air knife 130 is arranged at an angle θ of about sixty degrees relative to the direction of travel 200. The airflow exiting the elongate orifice of the air knife 130 is represented by arrows A through F. As the road surface clearing system advances along in the direction of arrow 200, and as water or debris is blown forward and partially laterally relative to the direction of travel by the air following the path of arrow A, the water or debris will be blown into the path of arrow B. As the air knife advances along the direction of travel 200, the air following the path of arrow B will approach the water or debris and it will be blown forward and laterally into the path of arrow C. This cascade continues until the debris or water is blown laterally out of the path of the air knife 130 as it advances along the direction of travel 200. This results in a "squeegee" effect of scraping or sweeping the water and/or debris out of the path of the air knife 130 in the direction of arrow 250.

As apparent to one of skill in the art, directing the water and/or debris to one side of the air knife 130 may allow, as necessary, a second or additional successive passes of the road surface clearing system to move the water or debris further in the direction of arrow 250. Optionally, a series of road surface clearing systems may be used to clear a swath wider than a single system illustrated in FIGS. 1 and 3.

While embodiments of the present invention may be scaled according to their intended use, limits may exist on the scalability with regard to how long an air knife can be to adequately deliver consistent air flow along the length of the elongate orifice. Further, limitations on the volume and pressure of the air fed into the manifold may limit the length of an air knife that can be effectively used. In an example embodiment, pressurized air may be supplied to the air knife of FIG. 1 at about one hundred pounds per square inch (psi).

Applicant has found a method and system according to embodiments of the present invention to create a road surface clearing method and system that are capable of clearing a wider swath than the single system illustrated in FIGS. 1 and 3. FIG. 5 illustrates such an example embodiment that includes three frames 310 connected together. The mechanism with which the frames are connected allows for articulation and rotation along at least two axes as will be described further below. FIG. 5 depicts strut rods 360 connecting together the front of the frames 310 and strut rods 365 connecting together the rear of the frames 310.

The illustrated embodiment depicts a manifold 350 arranged to distribute pressurized air received at the manifold 350 to each of three air knives 330. While the embodiment of FIG. 5 shows three frames 310 with three air knives 330 coupled together, the system described herein is modular such that any number of frames 310 and air knives 330 may be joined together in a similar fashion as that illustrated. The number of surface clearing systems coupled together may be determined, for example, based on a width of road surface that requires clearing, the width of access points to the road surface (e.g., access roads, gates, etc.), or the capacity of compressors used to feed pressurized air to a manifold. The air knives 330 may have a minimum pressure and minimum volume of air to adequately clear and/or dry a surface such that the capacity of the compressor(s) used may dictate the maximum number of air knives 330 that may be coupled together while remaining effective for clearing and/or drying a road surface. For example, the example embodiment of FIG. 5 may require compressed air at 100 psi and may require about 1500 to about 4500 cubic feet per minute (cfm) of air to adequately dry a surface about 18 feet in width.

According to the embodiment of FIG. 5, the compressor(s) coupled to the manifold 350 provide compressed air that is distributed through hoses 355 to each of the three air knives 330. As described with regard to the embodiment of FIGS. 1-4, each of the air knives 330 may be supplied with pressurized air at both ends of the air knife. Optionally, as noted above, the air knives may include orifices disposed along their length through which the pressurized air may be received.

FIG. 6 illustrates the example embodiment of FIG. 5 of three road surface clearing systems coupled together. The manifold 350, hoses 355, and related couplers are omitted from the illustration of FIG. 6. As shown, the frames 310 are offset from one another along the direction of travel. The offset allows for substantial alignment of the air knives 330. Alignment of the air knives 330 may improve the surface clearing efficiency of multiple air knives joined together as the effect described with regard to FIG. 4 may continue substantially seamlessly across multiple air knives. The air knives 330 of FIG. 6 are not aligned collinearly since the pressurized air supplied to the air knives 330 is supplied on the ends of the air knives. A minor offset may be used between the adjacent air knives 330. Including a minor offset between the air knives also allows the air knives to be arranged to overlap to a limited extent to ensure there is no un-swept area of the surface to be cleared.

As shown in FIG. 6, each of the frames 310 are connected together at the front, left corners 362 by strut rods 360, and at the back, right corners 367 by strut rods 365. The fasteners used to secure the strut rods 360, 365 to the frames may provide a fixed point for the end of the strut rods, but allow for pivoting about the fastened point. For example, the strut rods 360, 365, may each be connected at either end to respective corners 362, 367 by ball joint rod end fasteners. FIG. 7 illustrates an example embodiment of such a fastener 400 which may include a ball 410 defining a bore 405 configured to receive a fastener, such as a bolt, there through. The ball 410 is received within an eye 415 which holds the ball 410 securely, but allows rotation of the ball 410 within the eye 415. The fastener 400 may include a threaded end 420 arranged to be received within an end of the strut rod. The threaded end 420 may allow for adjustability of the overall length of the strut rod to accommodate manufacturing tolerances or to appropriately space the adjacent frames from one another. Optionally, a ball joint rod end fastener may include an internally threaded bore to receive a threaded end of a strut rod, or a solid shank configured to be welded to a strut rod.

Referring back to FIG. 6, the ball joint rod end fasteners, similar to that illustrated in FIG. 7, may be attached at either end of each of the strut rods 360, 365 and secured to the frames 310 with a fastener, such as a bolt, received through the bore 410 of the fastener and secured to the frame 310 at corners 362 and 367. The ball joint rod end fasteners may allow a degree of flexibility between the frames 310 rather than having the frames rigidly attached to one another.

FIG. 8 illustrates a detail view of two adjacent frames 310 connected together according to the example embodiment of FIGS. 5 and 6. FIG. 8 illustrates the strut rod 360 connecting the front left corner 362 of a first frame 310 to the front left corner 362 of an adjacent frame 310. Also illustrated is a tie rod 430 configured to connect the front of a first frame 310 at 435 to the back of an adjacent frame at 437. The tie rod 430 further includes ball joint rod ends for connection between the tie rod and the frames at 435 and 437. The combination of the tie rod 430 and the strut rods 360, 365 allow some degree of vertical displacement between frames 310 relative to the surface being cleared due to the ball joint rod end fastener connections at 362, 367, 435, and 437. However, the configuration of the tie rods 430 and strut rods 360, 365 also permits the frames 310 to pivot relative to one another. The collinear or substantially collinear arrangement of the fastener connections at 362B, 367, 435, and 437, as illustrated in FIG. 9, allows the frame 310A to pivot relative to frame 310B about the axis 480. Similarly, the collinear or substantially collinear arrangement of the fasteners at 362A and 435 allow the frame 310A to pivot about axis 470 relative to the adjacent frame 310B.

The ability of adjacent frames 310A, 310B to pivot relative to one another about axes 470 and 480, while retaining relative alignment of the air knives 330 allows the frames to traverse uneven road surfaces while keeping the air knives in close proximity to the surfaces they are to clear. An example embodiment of such a road surface may include a racetrack with banking, such as a racetrack with banked turns in which the banking increases as the distance from the apex of the turn increases, or banking on the ends or along the front or back stretches. In such an embodiment, a first frame (e.g., frame 310B) may be advancing along a banking of about fifteen degrees while the adjacent frame (e.g., frame 310A) may be advancing along a banking of about thirteen degrees. Absent the articulated connection between the two frames, the sides of the frames proximate to one another (i.e., proximate axis 480) would be suspended from the racetrack in the above described embodiment. The articulation between the frames allows each of the frames to maintain contact at all corners with the road surface and keeps the air knives in close proximity to the road surface to be cleared. This articulation of the frames may also be important for bringing the road surface clearing system onto or off of the racetrack, including crossing over the apron onto the track and from the track to a pit lane.

The degree to which the frames may pivot relative to one another along axes 480 and 470 may be dictated by the degree of rotation allowed at the ball joint rod end fasteners. In an example embodiment, the degree of pivot between the frames about axis 470 may be between about five and ten degrees, while the degree of pivot between the frames about axis 480 may be between about five and twenty degrees. In some example embodiments, the degree of pivot between the frames about axis 480 may be up to about 110 degrees to allow a road surface clearing system with three frames to fold the outermost frames up, leaving a footprint not substantially greater than a single frame for convenient storage and/or transport. In such an embodiment fasteners in addition to or other than ball joint rod ends may be used.

Referring back to FIG. 1, the road surface clearing system 100 may also include a guide wheel 180 attached to a side of the frame 110. A guide wheel may allow a road surface clearing system to be advanced along a wall to clear debris or water as close to the wall as possible. Without the guide wheel, contact may be made between the frame 110 or more sensitive components and the wall if the road surface clearing system 100 is moved too close to the wall, resulting in possible damage to the road surface clearing system 100.

As it may be important to clear debris and/or water from a road surface proximate a wall, such as at a safety retaining wall of a racetrack, it may be desirable for a road surface clearing system 100 to be held close to the wall as the system 100 is advanced. Due to banking, undulations, and driver error, it may be difficult to maintain the road surface clearing system 100 held proximate to the wall, even including a guide wheel 180.

To assist in maintaining guide wheel 180 of the road surface clearing system 100 in contact with a wall, a biasing force may be introduced to drive the road surface clearing system 100 against the wall. FIG. 10 illustrates a detail view of the system for providing a biasing force to the road surface clearing system 100 as shown in FIG. 3. FIG. 10 depicts the mounting plate 190 to which the tow bar 140 is hingedly connected at hinge points 145. As noted above, the hinge points 145 allow the tow bar to hinge about an axis defined between the two hinge points 145. The mounting plate 190 may be pivotably connected to the frame 110 at pivot point 195. The pivot point 195 allows the mounting plate 190 to pivot relative to the frame about an axis through pivot point 195, substantially orthogonal to the plane of the surface being cleared. A biasing element, a pneumatic cylinder 500 in the illustrated embodiment, may be coupled to the frame and may include a piston 500 that is coupled to the mounting plate 190 at 520. The pneumatic cylinder may apply a biasing force to the mounting plate along direction arrow 530 by extending piston rod 510. The biasing force, applied at a distance from the pivot point 195, cause the tow bar 140 and mounting plate 190 to be biased in a counter-clockwise direction according to the illustrated embodiment.

FIG. 11 illustrates the road surface clearing system 100 of FIG. 3 with the piston 510 of the pneumatic cylinder 500 extended, resulting in the tow bar 140 being pivoted about pivot point 195 relative to the frame 110. FIG. 12 illustrates the example embodiment of the surface clearing system 100 of FIGS. 3, 10, and 11 as towed behind a tow vehicle 600. As illustrated, the biasing force exerted by the pneumatic cylinder 500 drives the tow bar 140 counter clockwise, thereby pushing the road surface clearing system 100 to the right side of the tow vehicle 600. The biasing force holds guide wheel 180 of the road surface clearing system 100 in contact with the wall 610. As shown, the tow bar 140 may be pivotable relative to the tow vehicle as would be possible using a conventional ball-and-socket towing hitch. The tow vehicle 600 may be driven closer to the wall, moving the tow bar 140 clockwise relative to the frame 110, and the guide wheel 180 of the road surface clearing system 100 will maintain contact with the wall 610. Such a configuration may allow a tow vehicle to be driven close to a wall, but within a margin of error (e.g, up to around at least five feet) while keeping the road surface clearing system 100 in contact with the wall 610, thereby ensuring that debris and/or water is cleared from the surface as close to the wall 610 as possible.

Referring back to FIG. 10, the mounting plate 190 may include a pin 197 or other pivot stop to limit the degree to which the mounting plate 190 may pivot relative to the frame 110. In the illustrated embodiment, a pin 197 attached to the frame 110 engages a slot 193 of the mounting plate 190. The degree of pivot of the mounting plate 190 is limited by the ends of the slot 193 in which the pin 197 is disposed. Practically, referring back to the example embodiment of FIG. 12, a limit to the degree of pivot of the mounting plate 190 (and hence, the tow bar 140) relative to the frame 110 may limit how far to the right of the tow vehicle 600 the road surface clearing system 100 may drive itself askew of linear alignment with the tow vehicle 600. This may preclude the road surface clearing system 100 tow bar 140 from binding between the tow vehicle 600 and the road surface clearing system 100.

The mounting plate 190 may further be configured to be locked in place relative to the frame 110, such as to allow the tow bar 140 to be disposed at a fixed angle relative to the frame 110 or in line with the tow vehicle 600. Such a lock may be beneficial for transport of the road surface clearing system, in such case the tow bar would likely be secured to be in a straight line parallel to a direction of travel of the frame 110 as illustrated in FIG. 3. In other embodiments, the tow bar 140 may be locked at an angle to enable a tow vehicle to drive further from an edge of a surface that is to be cleared, while a wall may not be present to contact the guide wheel 180.

The pneumatic cylinder 500 of FIG. 10 used to bias the mounting plate 190 and tow bar 140 may be supplied with pressurized air from the manifold 150 shown in FIG. 1. The compressed air may be supplied to a regulator such that the pressure of the air at the pneumatic cylinder 500 may be controlled, thereby controlling the biasing force magnitude. While the illustrated embodiments include a pneumatic cylinder 500, many other biasing elements may be used, such as a coil spring, a deformable material (e.g., rubber), a clockspring about the pivot point 195, etc. As such, the pneumatic cylinder 500 illustrated is not intended to be limiting, but merely to provide an example of a biasing element that may provide the force necessary to achieve the aforementioned results.

While the illustrated embodiment depicts a biasing element configured to bias a mounting plate (and tow bar) counter-clockwise relative to the frame, embodiments may include biasing elements that permit biasing of the mounting plate and tow bar in the clockwise direction relative to the frame. Optionally, embodiments may be configured to bias the mounting plate and tow bar in both the clockwise and counter-clockwise directions, which may be achieved with multiple, independently controllable biasing elements (e.g., two pneumatic pistons) or a biasing element capable of applying a bias force in two directions. Such an embodiment may be beneficial for urging a road surface clearing system against opposite walls in dependence of the type of surface being cleared, or the direction of travel of the tow vehicle along the surface.

Further example embodiments may include a positioning element in place of, or in addition to the biasing element. For example, in an embodiment in which it is desirable to have a surface clearing system offset from the tow vehicle, a positioning element, such as an electric actuator or hydraulic cylinder may be configured to pivot a mounting plate about the pivot point to position the mounting plate in a substantially fixed location, thereby canting the road surface clearing system from the tow vehicle. Such an electric actuator or hydraulic cylinder may further be configured to be controlled remotely, such as by an operator of the tow vehicle. In such an embodiment, the alignment of the road surface clearing system behind the tow vehicle may be adjusted while the system is being advanced along a road surface.

Various other features for, modifications to and other embodiments of the inventions set forth herein will come to mind to one skilled in the art to which these inventions pertain having the benefit of the teachings presented in the foregoing descriptions and the associated drawings. For example, while examples discussed herein are often related to mobile printers, one skilled in the art would appreciate that other types of printers, such as desktop or less mobile printers, as well as other types of devices may benefit from embodiments discussed herein. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

That which is claimed:

1. A system for clearing a surface, the system comprising:

an air knife comprising an elongate orifice extending along a line;

a frame configured to support the air knife in a position substantially parallel to a plane defined by the surface;

a tow bar coupled to the frame, wherein the tow bar is pivotable relative to the frame along an axis orthogonal to the plane defined by the surface; and comprising a guide wheel attached to the frame, wherein the guide wheel has an axis of rotation orthogonal to the plane defined by the surface.

2. The system of claim 1, wherein the tow bar comprises a mounting plate, and wherein the mounting plate is pivotably mounted to the frame, wherein the mounting plate is pivotable in a first pivot direction about the axis orthogonal to the plane defined by the surface and pivotable in a second pivot direction, opposite the first pivot direction, about the axis orthogonal to the plane defined by the surface.

3. The system of claim 1, further comprising a biasing member configured to bias the tow bar in a first pivot direction about the axis orthogonal to the plane defined by the surface.

4. The system of claim 1, wherein a degree of pivot between the tow bar and the frame is limited by a pivot stop.

5. The system of claim 1, wherein a degree of pivot between the tow bar and the frame is between about zero degrees relative to a direction of travel of the system and forty-five degrees relative to the direction of travel of the system.

6. The system of claim 1, wherein the angle of incidence of air exiting the elongate orifice relative to the plane defined by the surface is between thirty degrees and sixty (60) degrees.

7. The system of claim 1, wherein the angle of incidence of air exiting the elongate orifice relative to the plane defined by the surface is about forty-five (45) degrees.

8. The system of claim 1, further comprising:

a manifold attached to the frame;

a first hose extending from the manifold to a first end of the air knife; and a second hose extending from the manifold to a second end of the air knife.

9. The system of claim 1, wherein the frame is a first frame and the air knife is a first air knife, the system further comprising:

a second air knife comprising an elongate orifice extending along a line; and a second frame configured to support the air knife in a position substantially parallel to the plane defined by the surface, wherein the second frame is pivotably attached to the first frame.

10. The system of claim 9, wherein the second frame is pivotable relative to the first frame about a first axis and about a second axis, wherein the first axis and the second axis are perpendicular, and wherein the first axis and the second axis are each parallel to the plane defined by the surface.

11. The system of claim 9, wherein a direction of travel of the first frame and a direction of travel of the second frame is held fixed and parallel to one another.

12. The system of claim 9, further comprising:

a manifold attached to one of the first frame or the second frame;

a first hose extending from the manifold to a first end of the first air knife;

a second hose extending from the manifold to a second end of the first air knife;

a third hose extending from the manifold to a first end of the second air knife; and a fourth hose extending from the manifold to a second end of the second air knife.

13. A system for clearing a surface, the system comprising:

a first air knife comprising an elongate orifice extending along a first line;

a first frame configured to support the first air knife in a position substantially parallel to a first plane defined by the surface beneath the first frame;

a second air knife comprising an elongate orifice extending along a second line; and a second frame configured to support the second air knife in a position substantially parallel to a second plane defined by the surface beneath the second frame;

wherein the first frame is connected to the second frame, and wherein the system is configured such that the first plane is non-parallel to the second plane.

14. The system of claim 13, wherein the system defines a direction of travel in which the system is configured to be advanced by a tow vehicle, wherein the first frame is pivotable relative to the second frame about a first axis parallel to the direction of travel.

15. The system of claim 14, wherein the first frame is pivotable relative to the second frame about a second axis that is perpendicular to the direction of travel, wherein the second axis is parallel to at least one of the first plane or the second plane.

16. The system of claim 13, further comprising:

a mounting plate pivotably mounted to the first frame and pivotable relative to the frame about an axis orthogonal to the first plane; and a tow bar mounted to the mounting plate.

17. The system of claim 16, further comprising a biasing member configured to bias the mounting plate in a first pivot direction about the axis orthogonal to the first plane.

18. The system of claim 17, further comprising a guide wheel attached to the frame, wherein the system defines a direction of travel in which the system is configured to be advanced by a tow vehicle, and wherein the guide wheel is configured to contact a wall extending parallel the direction of travel.

19. The system of claim 17, wherein the biasing member is configured to bias the guide wheel to contact with the wall.

20. A system for clearing a surface, the system comprising:

a first air knife comprising an elongate orifice extending along a line;

a first frame configured to support the air knife in a position substantially parallel to a plane defined by the surface;

a second air knife comprising an elongate orifice extending along a line; and a second frame configured to support the air knife in a position substantially parallel to the plane defined by the surface, wherein the second frame is pivotably attached to the first frame; and a tow bar coupled to the frame, wherein the tow bar is pivotable relative to the frame along an axis orthogonal to the plane defined by the surface.

* * * * *